US007309184B2

(12) United States Patent
Butcher et al.

(10) Patent No.: US 7,309,184 B2
(45) Date of Patent: Dec. 18, 2007

(54) DISPENSER FOR FLUID MATERIALS

(75) Inventors: John D. Butcher, Scotch Plains, NJ (US); Leo Clifford Pires, Basking Ridge, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 10/641,651

(22) Filed: Aug. 15, 2003

(65) Prior Publication Data

US 2005/0036823 A1 Feb. 17, 2005

(51) Int. Cl.
*B47K 5/06* (2006.01)

(52) U.S. Cl. ..... 401/172; 401/182; 401/266

(58) Field of Classification Search ..... 401/172, 401/174, 175, 261–263, 266, 171, 176, 182, 401/265

See application file for complete search history.

(56) References Cited

U.S. PATENT DOCUMENTS

| | | | | | |
|---|---|---|---|---|---|
| 1,890,319 | A | | 12/1932 | Eckstein | |
| 2,728,097 | A | | 12/1955 | Seifert | |
| 2,816,309 | A | | 12/1957 | Worth et al. | |
| 3,002,517 | A | | 10/1961 | Pitton | |
| 3,226,762 | A | * | 1/1966 | Norman | 401/175 |
| 3,616,970 | A | * | 11/1971 | Baumann et al. | 222/187 |
| 3,825,021 | A | * | 7/1974 | Seidler | 132/320 |
| 4,139,127 | A | | 2/1979 | Gentile | |
| 4,408,920 | A | | 10/1983 | Walther et al. | |
| 4,801,052 | A | | 1/1989 | Citterio | |
| 4,887,924 | A | | 12/1989 | Green | |
| 4,954,000 | A | | 9/1990 | Gueret | |
| 4,993,857 | A | * | 2/1991 | Ohba | 401/75 |
| 5,009,534 | A | | 4/1991 | Gueret | |
| RE34,751 | E | | 10/1994 | Thompson | |
| 5,454,660 | A | * | 10/1995 | Sakurai et al. | 401/266 |
| 5,772,347 | A | | 6/1998 | Gueret | |
| 5,839,622 | A | * | 11/1998 | Bicknell et al. | 222/390 |
| 5,842,802 | A | | 12/1998 | Lang et al. | |
| 5,851,079 | A | * | 12/1998 | Horstman et al. | 401/174 |
| 5,879,095 | A | | 3/1999 | Gueret | |
| 6,116,803 | A | | 9/2000 | Szekely et al. | |
| 6,186,686 | B1 | | 2/2001 | Neuner et al. | |
| 6,234,698 | B1 | | 5/2001 | De Laforcade | |

(Continued)

FOREIGN PATENT DOCUMENTS

| | | |
|---|---|---|
| CH | 8297/78 | 8/1978 |

OTHER PUBLICATIONS

Michelle Maniscalco, *IMM Magazine Article Archive*, "Materials Update: Ultrasoft TPEs march forward (Web exclusive: expanded content)", pp. 1-3 (Jul. 2003).

*Primary Examiner*—Huyen Le
(74) *Attorney, Agent, or Firm*—Fitzpatrick, Cella, Harper & Scinto

(57) ABSTRACT

A dispenser for fluid materials, such as cosmetic products, having a hollow housing to store the product. The housing has apertures from which the product may be dispensed upon actuation of a piston, which may be accomplished in a one-handed operation. The piston forces the product out from within the housing to dispense the material into a compliant pad having apertures forming reservoirs for application by the consumer.

20 Claims, 6 Drawing Sheets

U.S. PATENT DOCUMENTS 6,238,117 B1 5/2001 Griebel et al.
6,309,128 B1 10/2001 Griebel et al.
6,488,427 B1 12/2002 Breidenbach et al.
6,745,781 B2 * 6/2004 Gueret ..... 132/320
6,793,431 B1 * 9/2004 Tsai ..... 401/172
2002/0014254 A1 2/2002 Gueret
2002/0048483 A1 * 4/2002 Altonen et al. ..... 401/266
2002/0090247 A1 7/2002 Breidenbach et al.
2003/0057236 A1 3/2003 Delage
2003/0129016 A1 * 7/2003 Gueret ..... 401/202

* cited by examiner

DISPENSER FOR FLUID MATERIALS

BACKGROUND OF THE INVENTION

The present invention relates in general to dispensers for fluid materials, and more particularly, to dispensers for dispensing materials having a semi-solid consistency such as cosmetic products.

Conventional cosmetic dispensers are used for various classes of cosmetic products, including mascaras, lipsticks, and deodorants. These dispensers are employed for various formulations of products which are in semi-solid form such as pastes, gels, creams, and the like. Typically, such dispensers include a hollow housing having a piston which is advanced by rotation of an advancement mechanism to build pressure within the housing. The product is dispensed through one or more apertures at the end of the dispenser upon sufficient pressure build-up.

In conventional dispensers of this type, the product is forced from the housing such that it may be applied to the user. The product generally accumulates directly on the end of the housing after being dispensed. Because most housings are formed from impervious and relatively hard materials such as plastic, application to the user in a controlled manner is often difficult. This is especially important in the case of lipsticks where precise application is desired. For example, in such conventional dispensers, it is often difficult to accurately dispense the requisite amount of product required. Often, too much product is dispensed from the housing causing non-uniform application to the user.

Recent dispensers have improved on the conventional design by adding various materials to the end of the housing adjacent to the product dispensing apertures. One such material is flocking. Flocking is typically a nylon or polyester fiber with a diameter of approximately 1 to 5 denier and a length of approximately 0.25 millimeters (0.01 inch) to about 1.5 millimeter (0.06 inch). The purpose of the flocking is to assist with uniform dispensing of the product. Another disadvantage is that the flocking material offers only a minor level of resiliency. Thus, when pressed against the lips of a user, it is difficult for the user to ascertain the amount of pressure to be applied such that the requisite amount of product is transferred to the user's lips. In addition, it is often the case that the user pushes down on the flocking to such a degree that the hard outer housing contacts the user, rendering the flocking of little use.

Dispensers are known for a conventional solid lipstick bullet which are constructed to facilitate one-handed application. The dispensers generally include an elongated cylindrical container having a hollow interior. A holder to which a lipstick bullet is attached is typically slidably received within the container. The container includes an advancement mechanism accessible to the user. Upon rotation of the advancement mechanism relative to the container, the lipstick bullet is moved from a retracted position within the container to an extended position enabling application by the user. However, these dispensers are not suitable for dispensing cosmetics such as lipstick material which have a semi-solid consistency.

It is therefore desirable to provide a dispenser for fluid materials such as cosmetics having a semi-solid consistency which may be dispensed from the dispenser in a one-handed operation.

SUMMARY OF THE INVENTION

In accordance with one embodiment of the invention, there is disclosed a dispenser for fluid materials comprising a housing having a hollow interior adapted for containing a fluid material to be dispensed, the housing having a first end with at least one first aperture therethrough; a compliant pad overlying the first end of the housing having at least one second aperture in registration with the at least one first aperture of the housing; and a piston moveable within the housing towards the first end of the housing, the piston adapted for forcing the fluid material through the at least one first aperture and the at least one second aperture.

In accordance with a further embodiment of the invention, there is disclosed a dispenser for fluid materials comprising a housing having an opening and containing a fluid material within an upper portion thereof, the housing having a first end supporting a compliant pad, the first end and the pad having at least one aperture for the dispensing of the fluid material therethrough; a piston moveable within the upper portion of the housing; a carrier having an upper end coupled to the piston and an internal threaded lower end; a screw having a threaded portion received within a lower portion of the housing, the screw engaging the internal threaded lower end of the carrier, whereby rotation of the screw advances the piston towards the first end of the housing, the screw further include a geared roller extending from within the housing through the opening; a rotatable sleeve surrounding a portion of the housing, the sleeve having an internal threaded lower end engaging the geared roller; and a base coupled to the lower portion of the housing.

In accordance with a further embodiment of the invention, there is disclosed a dispenser for fluid materials comprising a housing containing a fluid material, the housing having a first end supporting a compliant pad having at least one aperture for the discharge of the fluid material therethrough; and a cover for the housing having a portion thereof engaging the pad surrounding the at least one aperture for creating a hermetic seal.

In accordance with a further embodiment of the invention, there is disclosed a dispenser for fluid materials comprising a housing containing a fluid material, the housing having a first end supporting a compliant pad having at least one aperture for the discharge of the fluid material therethrough; wherein the pad has a hardness in the range of 15-75 durometer, Shore 00 scale.

In accordance with a further embodiment of the invention, there is disclosed a method of applying a fluid material, the method comprising supplying an applicator having fluid material therein and a compliant pad having at least one aperture in fluid communication with the third material; rotating a portion of the applicator to dispense an amount of the fluid material into the at least one aperture of the pad; pressing the pad against a surface to apply the fluid material to the surface.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION

In describing the preferred embodiments of the subject matter illustrated and to be described with respect to the drawings, specific terminology will be resorted to for the sake of clarity. However, the invention is not intended to be limited to the specific terms so selected and it is to be understood that each specific term includes all technical equivalents which operate in a similar manner to accomplish a similar purpose.

In a similar regard, although not limited to use as a lipstick applicator, the dispenser for fluid materials will be generally described as such for the sake of convenience. It is to be understood, however, that the dispenser for fluid materials of the present invention may be utilized to dispense various liquids, pastes, semi-liquids, semi-solids, gels, and the like. Such materials are preferably derived from the cosmetics industry and may include lipsticks, mascaras, eye shadow and other materials for topical application. However, other fluid materials such as sunscreens, topical ointments, medicated creams, salves and the like may be dispensed using the dispenser of the present invention. Also for convenience, all such materials will be generally referred to as fluid materials, although they may have semi-solid, paste-like or other consistencies.

In the preferred embodiment, the dispenser for fluid materials is designed to provide one-handed application of the material to be dispensed in a controlled manner. The material, such as a lipstick, is stored within a container and is dispensed therefrom in response to pressure applied by a piston translated through the hollow dispenser upon actuation of a rotatable advancement mechanism. The dispenser also includes a soft, gel-like elastomer perforated pad acting as a reservoir for the dispensed material, as well as acting as an applicator therefore. The pad also helps to hermetically seal the material within the dispenser for sanitary purposes and to prevent evaporation once a protective closure cover is placed over the dispenser. It is to be understood that the features to be described with respect to the dispenser may also be incorporated into the design of dispensers intended for other than one-handed operation.

Figure 1:
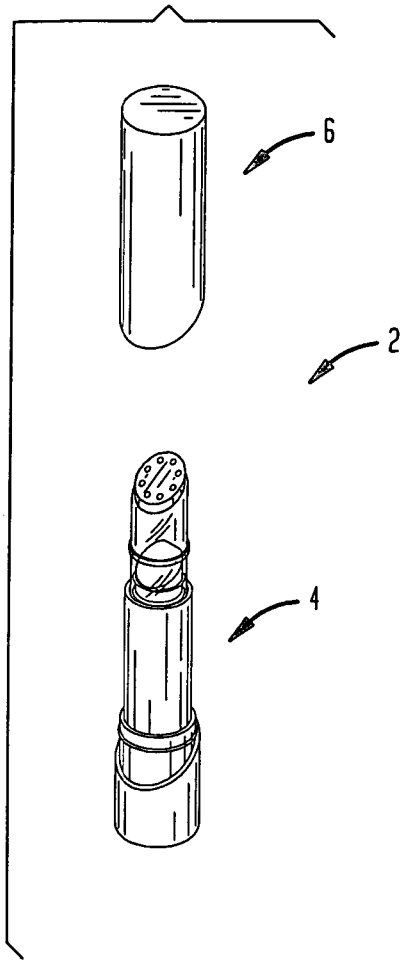
FIG. 1 is a perspective view of a dispenser for fluid materials constructed in accordance with one embodiment of the present invention showing its closure cover removed.

Referring to FIG. 1, the dispenser 2 includes an applicator 4 and a cover 6. The cover 6 is designed to fit over the applicator 4 to protect the applicator from being contaminated or otherwise damaged, as well as to hermetically seal the lipstick material within the applicator 4. The dispenser 2 has the general appearance of a conventional lipstick dispenser, especially with the cover 6 in place.

Figure 2:
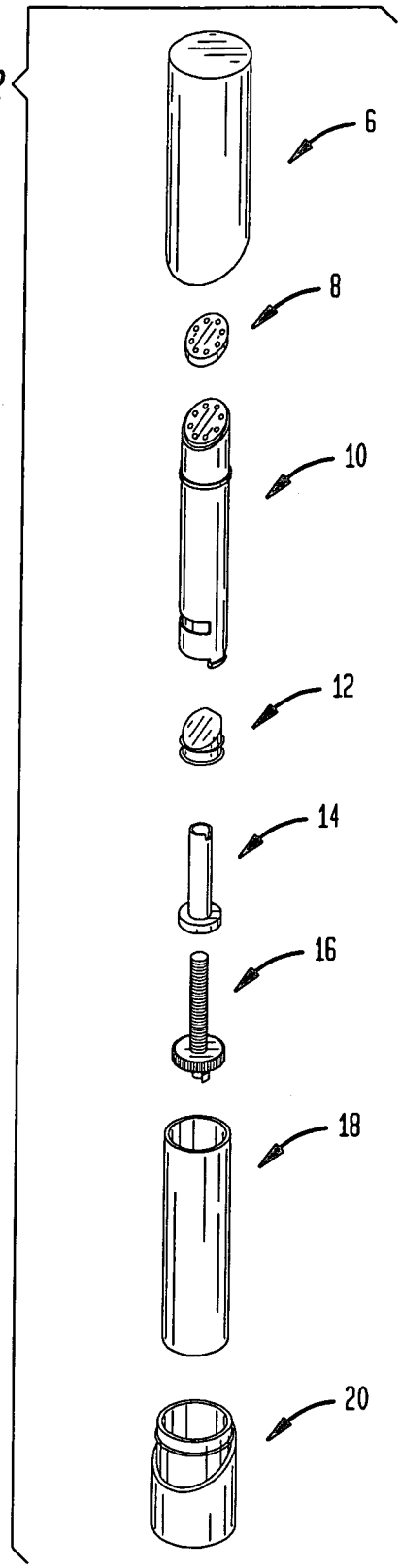
FIG. 2 is an exploded unassembled perspective view of the dispenser for fluid materials of the present invention as shown in FIG. 1.
Figure 3:
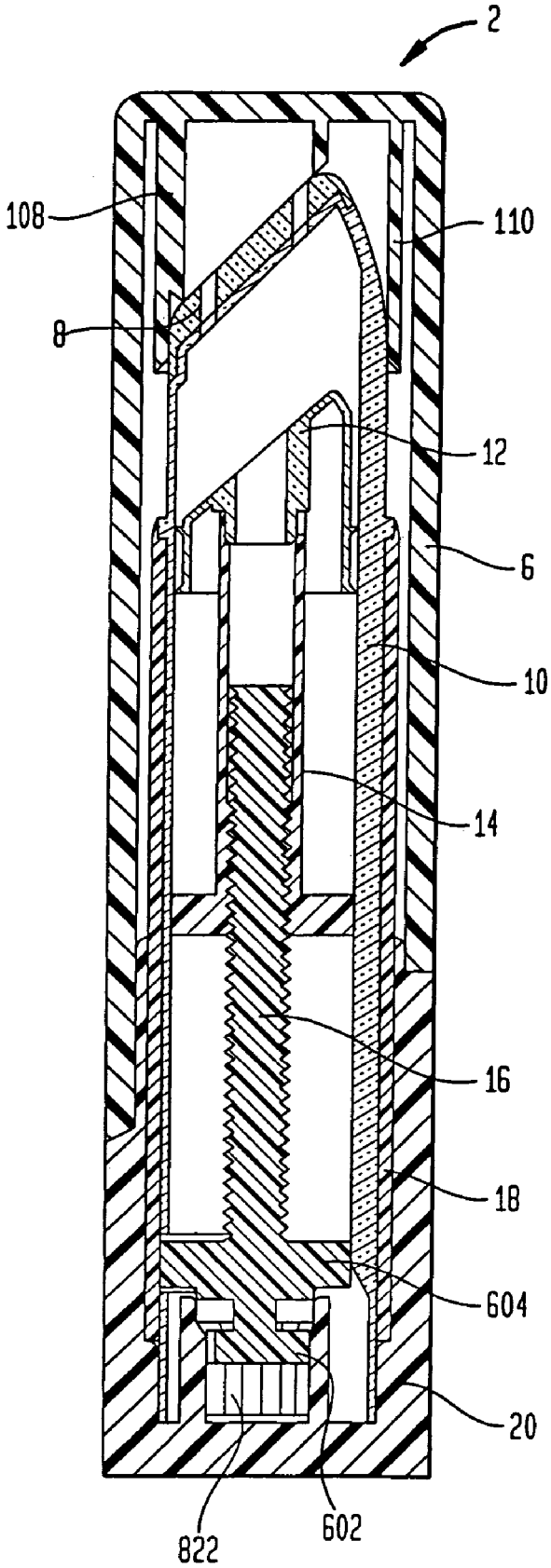
FIG. 3 is a cross-sectional view of the dispenser for fluid materials of the present invention in a fully assembled condition.

The applicator 4 is shown unassembled in FIG. 2 exploded into its several components which includes a pad 8, cartridge housing 10, piston 12, carrier 14, screw 16, sleeve 18 and base 20. The features of these components and their methods of interacting with each other within the assembled dispenser 2 will be discussed in turn. Generally, as shown in FIG. 3, the base 20 and the cover 6 longitudinally engage each other to enclose the remaining elements of the applicator 4. Within the applicator 4, the cartridge housing 10 fits within the length of the sleeve 18. Slideably disposed within the cartridge housing 10 is the piston 12 mounted on the carrier 14 which is threaded to the screw 16. The cartridge housing 10, screw 16 and sleeve 18 are operationally coupled to the base 20. Finally, the pad 8 is disposed upon the end of the cartridge housing 10.

Figure 4:
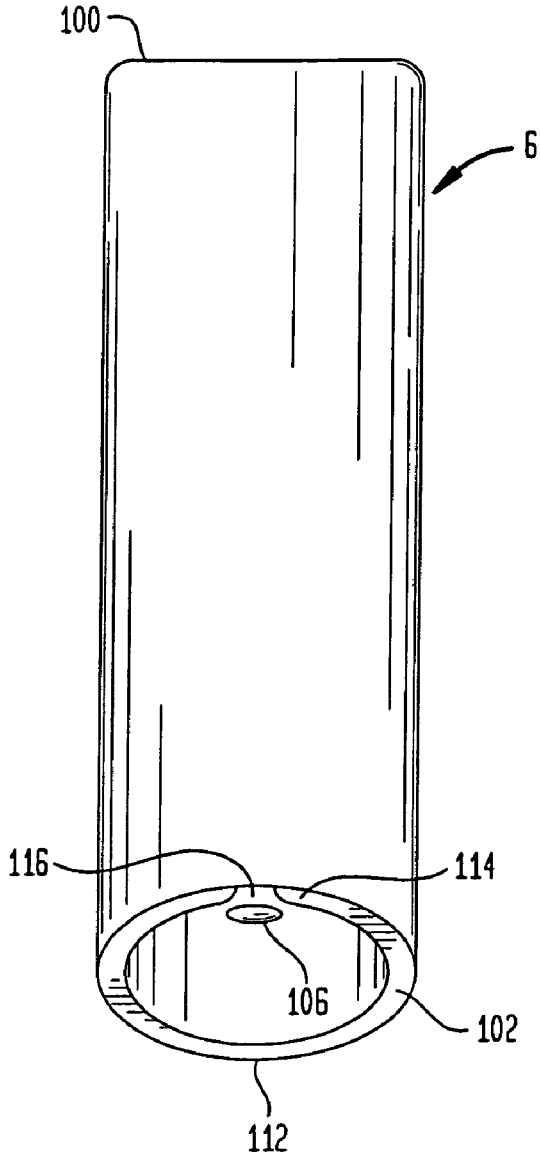
FIG. 4 is a rear elevational view of the closure cover which forms a part of the dispenser for fluid materials of the present invention.

Referring to FIG. 4, the cover 6 is generally cylindrical in shape with a flat top 100 and as loped bottom 102. The cover 6 may be formed from styrene acrylic nitrile, or other polymer materials, and is typically opaque. The cover 6, as well as the other components, may also be emblazoned with distinguishing markings or colors indicative of the source of the product or otherwise having a particular meaning. The top 100 of the cover 6 is closed while the bottom 102 is open such that the cover 6 forms a hollow compartment 104, as shown in FIG. 5.

The cover 6 may include a plurality of nibs 106 extending into the compartment 104. As will be discussed hereinafter, the nibs 106 interact with portions of the base 20 to assist releasably securing the cover 6 over the applicator 4. Generally, the nibs 106 are simply small bulges formed within the cover 6 during the molding process. Other similar structures, such as ribs, embossments, or the like may also be utilized to serve the same function.

Figure 5:
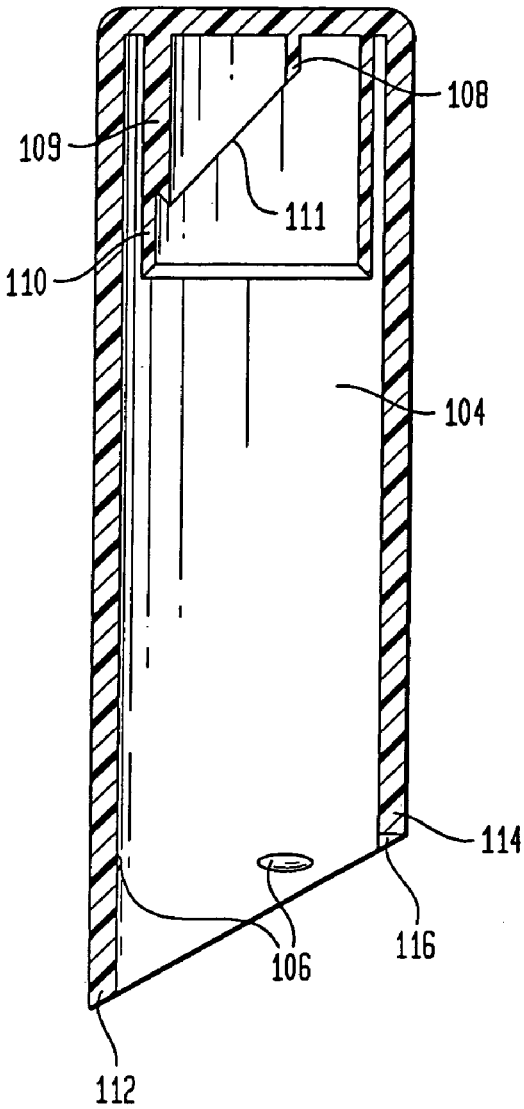
FIG. 5 is a cross-sectional view of the closure cover.
Figure 6:
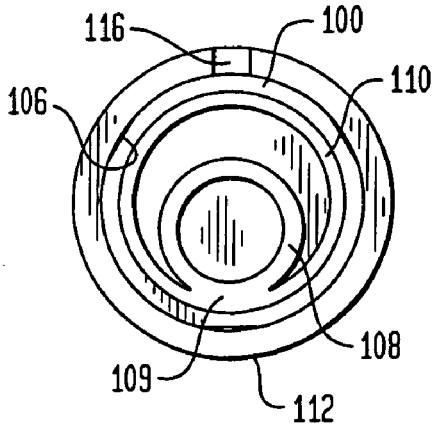
FIG. 6 is a bottom plan view of the closure cover.

As shown in FIGS. 5 and 6, the cover 6 includes an inner ring 108 and an outer ring 110 eccentrically arranged extending downwardly from the top 100 within the compartment 104. In this regard, the outer ring 110 is generally centered within the cover 6, while the inner ring 108 is offset toward the front 112 of the cover. Portions of the inner ring 108 and the outer ring 110 near the front 112 overlap so as to form a single integral wall 109. The outer ring 110 extends downwardly from the top 100 of the cover 6 an equal amount about its circumference, as shown in FIG. 5. On the other hand, the inner ring 108 varies in length such that the portions of the inner ring closest to the front 112 of the cover 6 are longer than the portions of the inner ring closest to the rear 114 of the cover. This provides the inner ring 108 with an angled open end 111. Generally, the purpose of the inner ring 108 is to hermetically seal the fluid material within the applicator 4 while the outer ring 110 serves to center the cover 6 upon the applicator, when the cover is installed. A notch 116 may be provided at the rear 114 of the cover 6 to align the cover 6 upon the base 20.

Figure 7:
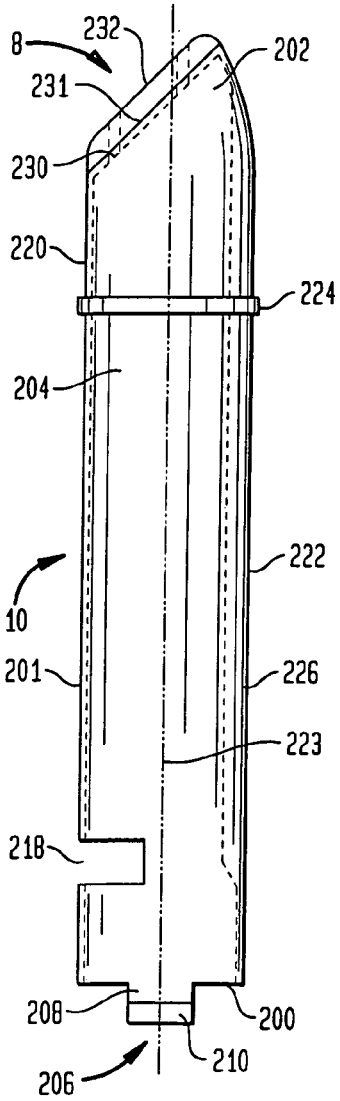
FIG. 7 is a side elevational view of the cartridge housing which forms a part of the dispenser for fluid materials of the present invention.
Figure 8:
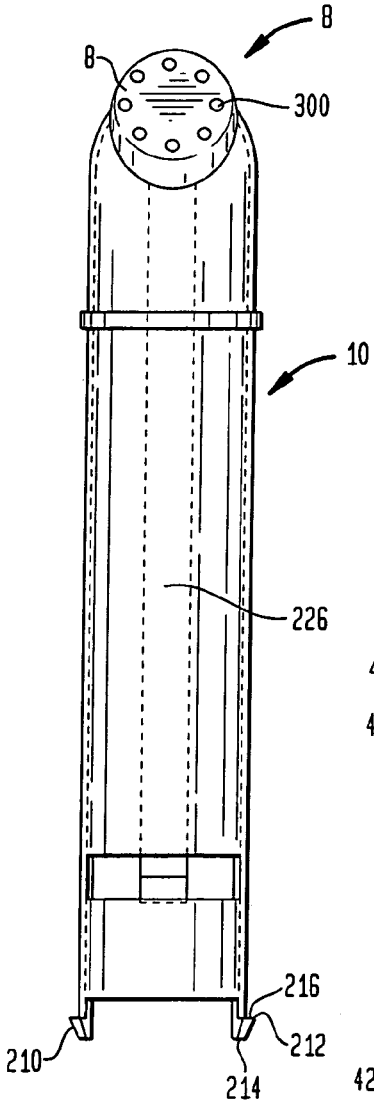
FIG. 8 is a front elevational view of the cartridge housing.
Figure 9:
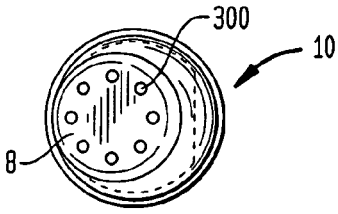
FIG. 9 is a top plan view of the cartridge housing.

Referring to FIGS. 7-9, the housing 10 may be formed from polypropylene or other polymer materials. The cartridge housing 10 is generally an elongated cylinder having a relatively flat bottom 200 and an angled upper top 202. The upper top 202 of the cartridge housing 10 is generally closed and the bottom 200 is generally open such that the housing forms a hollow compartment 204 therebetween.

A pair of spaced part tabs 206 extend away from the bottom 200 of the cartridge housing 10. Each of the tabs includes an extension member 208, extending downward from the bottom 200 of the housing 10, to a locking portion 210. As shown more clearly in FIG. 8, the locking portions 210 are sloped such that their proximal ends 212 are wider than their distal ends 214. Because the proximal end 212 of the locking portion 210 is wider than the extension member 208, a flat ridge 216 is formed at the intersection of the locking portion and the extension member. The tabs 206 serve to lock the cartridge housing 10 to the base 20, so as to hold the applicator 4 together in assembled relationship as will be discussed hereinafter.

A slotted opening 218 is formed near the bottom 200 of the cartridge housing 10. The slotted opening 218 begins at the front 220 and extends towards the rear 222 of the housing 10, ending before the longitudinal centerline 223 of the housing. As will be discussed, the slotted opening 218 permits portions of the screw 16 to extend therethrough into contact with the sleeve 18.

A rib 224 is formed around the exterior perimeter of the cartridge housing 10 near top 202. Upon assembly of the applicator 4, the rib 224 marks a dividing line between the upper top 202 of the housing 10, which is visible to the user, and the lower bottom 201 of the housing 10 which is concealed within the carrier 18.

A spine 226, having tapered ends, protrudes longitudinally along the length of the cartridge housing 10 within the compartment 204 from the upper top 202 of the housing to near the bottom 200 of the housing. Typically, the spine 226 is formed as a generally flat member integral with the housing 10. As will be discussed hereinafter, the spine 226 prevents the piston 12 from rotating relative to the cartridge housing 10 as the piston is advanced.

The upper top 202 of the cartridge housing 10 is angled such that the front 220 is lower than the rear 222 forming an angled planar surface 231 between the front and rear of the housing. One or more, and preferably a plurality of apertures 230 are formed within the angled planar surface 231. As will be discussed hereinafter, the apertures 230 permit release of the fluid material for application upon the build-up of sufficient pressure within the compartment 204 of the cartridge housing 10.

Referring to 8, the pad 8 is formed of a soft, compressible gel-like elastomer having compliant properties. The pad 8 is preferably formed of styrenic block copolymers incorporating hydrogenated isoprene rubber such as the Monoprene® brand. Monoprene® is a registered trademark of Teknor Apex, 505 Central Avenue, Portucket, R.I. 02861. The pad 8 is compressible against the user's skin, and therefore, should preferably have a soft feel. The pad 8 may have a hardness in the range of 15-75 durometer on the Shore 00 Scale, more preferably in the range of 30-50 durometer, and more preferably about 30 durometer, on the Shore 00 scale.

As shown in FIG. 9, the pad 8 is typically circular in shape with tapering edges and includes apertures 300 extending through its thickness. It will be appreciated, that the apertures 300 of the pad 8 are generally in registration with the apertures 230 of the angled surface 232 of the cartridge housing 10. In the preferred embodiment, the apertures 230 are cone shaped having a larger surface opening than the opening of the apertures abutting the angled surface 232. The cone-shaped apertures 230 act as material reservoirs which facilitate controlling the amount of the material dispensed by the applicator 4. It is to be understood that the apertures 230, 300 may be the same or different shape, the same or different size, as well as arranged in any desired pattern. Thus, the apertures 230 may be in the nature of slots overlaid with the pad 8 having cone-shaped apertures 300. In the preferred embodiment, the apertures 230, 300 have their longitudinal axis aligned vertically with the longitudinal axis of the carriage housing 10.

The pad 8 may be adhered to the housing using known techniques such a chemical bonding. Preferably, however, the pad 8 is overmolded with the cartridge housing 8 during the molding process. Overmolding improves the properties of the final product by seamlessly integrating and joining the multiple formulations in the molding process. Because the separate materials are not mechanically assembled, hygienic concerns are typically minimized as the "joint" between the two materials is non-existent.

Figure 11:
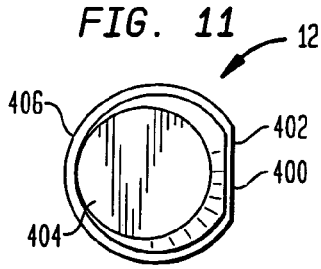
FIG. 11 is a top plan view of the piston.
Figure 10:
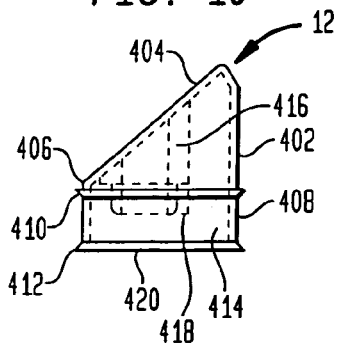
FIG. 10 is a side elevational view of the piston which forms a part of the dispenser for fluid materials of the present invention.
Figure 12:
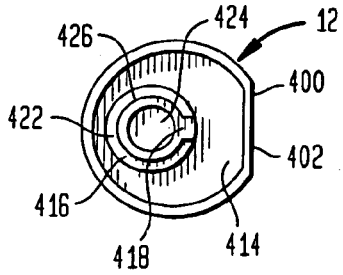
FIG. 12 is a bottom plan view of the piston.

Referring to FIGS. 10-12, the piston 12 is adapted to slidingly fit within the compartment 204 of cartridge housing 10. As shown in FIG. 11, the piston 12 is generally circular with a flat side 400 at its rear 402. It will be appreciated that the flat side 400 will be in general contact with the spine 226 of cartridge housing 10 when the piston 12 is inserted therein, to prevent rotation of the piston relative to the housing. The piston 12 is generally translucent, and may be formed from low-density polyethylene. The piston 12 may be clear or may be color matched to the fluid material being dispensed.

The piston 12 further includes an angled planar surface 404 extending upward from the front 406 to the rear 402. The angled surface 404 preferably matches the incline of the angled surface 231 of the cartridge housing 10 such that the angled surfaces may be positioned flush with each other when the piston 12 is fully advanced.

The midsection 408 of the piston 12 is bordered by a first flange 410 and a spaced apart second flange 412 which functions as seals. The outside diameter of the flanges 410, 412 closely match the inside diameter of the cartridge housing 10 such that the fluid material placed within the housing will preferably be unable to pass from above the first flange 410. If some material does pass the first flange 410, it will preferably be captured within the pistons midsection 408 by the second flange 412. As shown in FIG. 10, the midsection 408 of the piston 12 is of a slightly smaller diameter than the flanges 410, 412.

Within the interior of the body 414 of the piston 12 is an extension member 416 formed by an outerwall 222 which extends from the angled surface 404. The extension member 416 is generally cylindrical in shape with a tab 418 formed on its outer edge closest to the rear 402 of the piston 12. The longitudinal axis of the extension member 416 is eccentric to the longitudinal axis of the piston 12.

Within an opening 424 created by the outer wall 422 rests a support 426. The support 426 is in the nature of a flange extending from the outer wall 422 to strengthen the extension member 416. As will be discussed, the carrier 14 fits over the extension member 416 in pressure fit to connect the carrier to the piston 12.

Figure 13:
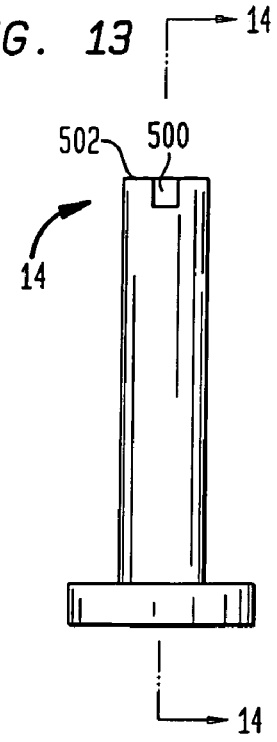
FIG. 13 is a rear elevational view of the carrier which forms a part of the dispenser for fluid materials of the present invention.
Figure 14:
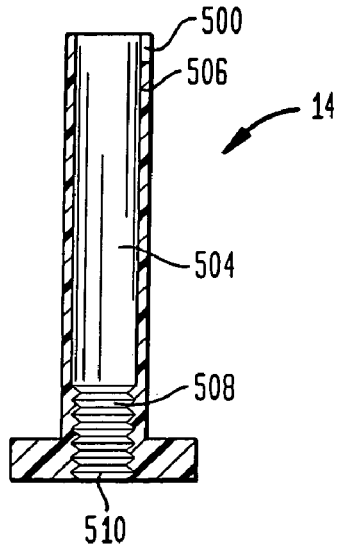
FIG. 14 is a cross-sectional view of the carrier.

The carrier 14, which engages the extension member 416 of piston 12, is generally an elongated cylinder having a notch 500 at its top edge 502 as best shown in FIG. 13 and a circular flange at its lower end. The notch 500 is adapted to fit around tab 418 of piston 12. Meanwhile, the free end of the extension member 416 of piston 12 fits within the interior 504 of carrier 14 to securely engage the two members in a friction fit.

The upper portion of the interior surface 506 of the carrier 14 is generally smooth. However, a lower portion 508 of the interior surface is provided with a threaded portion 510. The carrier 14 may be formed from a synthetic resin such as Delrin®. Delrin® is a registered trademark of the E.I. DuPont De Nemours and Company, 1007 Market Street, Wilmington, Del.

Figure 15:
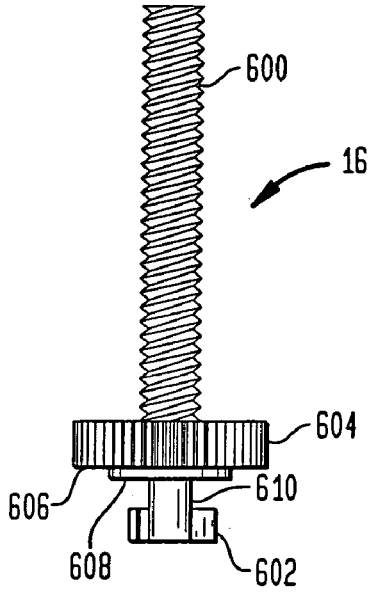
FIG. 15 depicts a front elevational view of the screw forming a part of the dispenser for fluid materials of the present invention.
Figure 16:
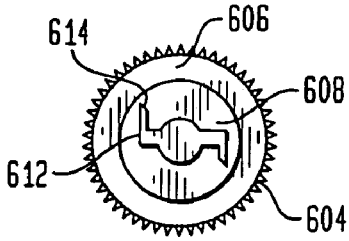
FIG. 16 is a bottom plan view of the screw.

The screw 16, shown in FIG. 15, is adapted to thread into the threaded portion 510 of carrier 14. The screw 16 includes a threaded portion 600, a winged portion 602 and a geared roller 604 arranged therebetween. As previously discussed, the threaded portion 600 of screw 16 is adapted to engage the threaded portion 510 of the carrier 14. Preferably, the carrier 14 is of sufficient length to receive the entire threaded portion 600 of screw 16.

The geared roller 604 has a larger diameter than the threaded portion 600 of the screw 16. As discussed, the geared roller 604 is adapted to be received within the opening 218 of cartridge housing 10 upon assembly of the applicator 4. Rotation of the geared roller 604 rotates the screw 16 so as to elevate the carrier 14, and hence, to drive the piston 12 within the cartridge housing 10.

The bottom portion 606 of the geared roller 604 includes a circular base 608 upon which the winged portion 602 is mounted. The circular base 608 is slightly smaller in diameter than the geared roller 604 and is concentric therewith. A shaft 610 of the winged portion 602 extends from the base 608. Extending from the shaft 610 approximately 180° apart are two L-shaped vanes 612. Each of the L-shaped vanes 612 end in a point 614 at its extreme distal end.

The screw 16 is preferably constructed from Delrin®. The threaded portion 600 of screw 16 typically includes a fine thread pattern to permit precise product delivery. As discussed, rotation of the geared roller 604 of the screw 16 will cause the carrier 14 to move away from the geared roller 604, thus pushing the piston 12 towards the top 202 of the cartridge housing 10, forcing material to be dispensed from the apertures 230 of the housing and apertures 300 of the pad 8.

Figure 17:
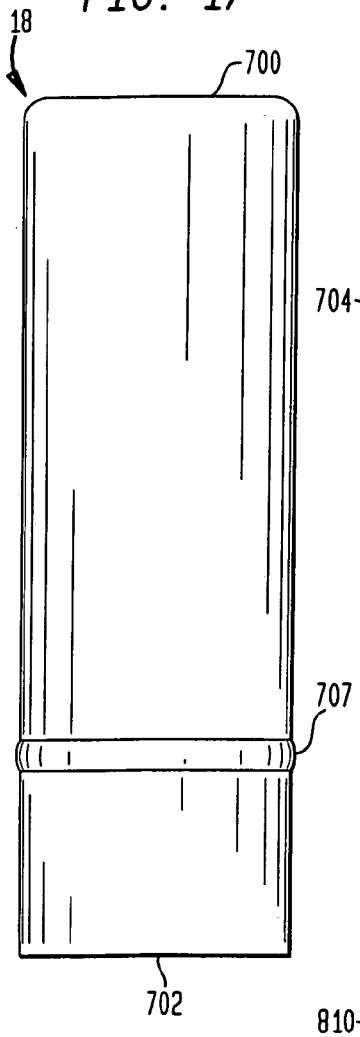
FIG. 17 is a front elevational view of the sleeve which forms a part of the dispenser for fluid materials of the present invention.
Figure 18:
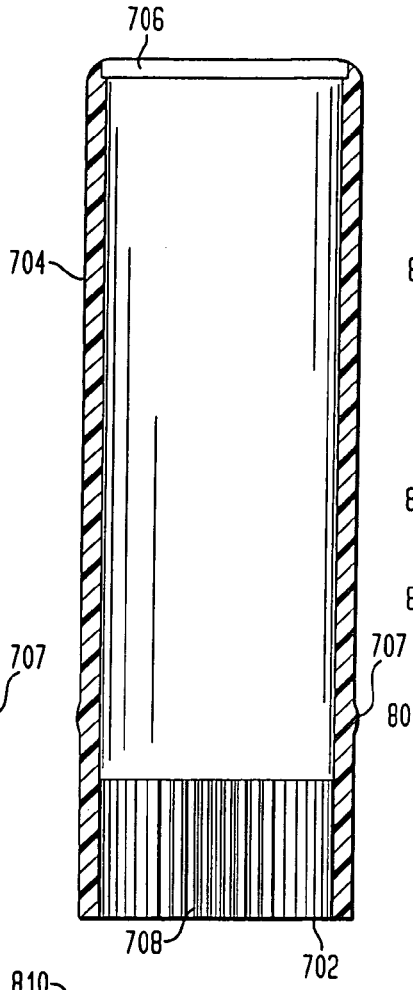
FIG. 18 is a cross-sectional view of the sleeve.

Referring to FIG. 17, the sleeve 18 is typically constructed of polypropylene or other polymer material, and may be color-matched to the cover 6 and base 20. The sleeve 18 is an elongated cylindrical body with an open top 700 and an open bottom 702. The interior diameter of the sleeve 18 is sized just slightly larger than the outside diameter of the cartridge housing 10, such that the housing may slidingly fit within the sleeve. At the top 700 of the sleeve 18, the inside wall 704 forms an inwardly directed ledge 706. The ledge 706 engages with the rib 224 of housing 10 when the housing is inserted into the top 700 of the sleeve 18 from its bottom 200. A rib 707 circumscribes the cartridge housing 10 so as to function as a spacer when the housing is inserted into the base 20.

The inside wall 704 of the carrier 18 is provided with gear teeth 708 near the bottom edge 702. The gear teeth are adapted to engage the geared roller 604 of the screw 16 when the applicator 4 is fully assembled. Thus, rotation of the carrier 18 will influence rotation of the screw 16 to advance the piston 12.

Figure 19:
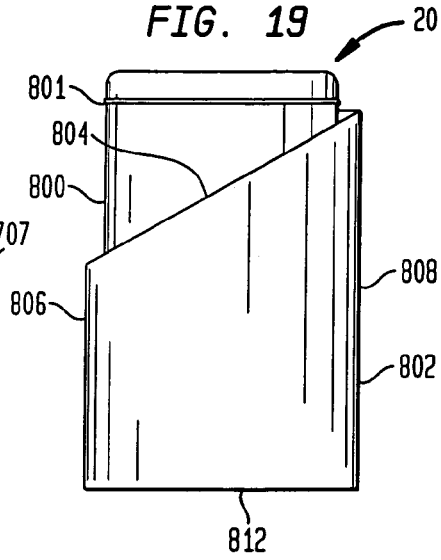
FIG. 19 is a side elevational view of the base which forms a part of the dispenser for fluid materials of the present invention.

The base 20 may be formed from styrene acrylic nitrile, or other polymer materials. As shown in FIG. 19, the base 20 includes an upper section 800 and a lower section 802.

The base 20 is generally cylindrical, with the upper section 800 having a smaller exterior diameter than the lower section 802. The border 804 between the upper section 800 and the lower section 802 is angled upward from the front 806 to the rear 808 of the base 20. This angle corresponds to the angle of the cover 6 at its bottom 102 where it is angled from the front 112 to the rear 114. Encircling the circumference of the upper section 800 is a flange 801.

Figure 21:
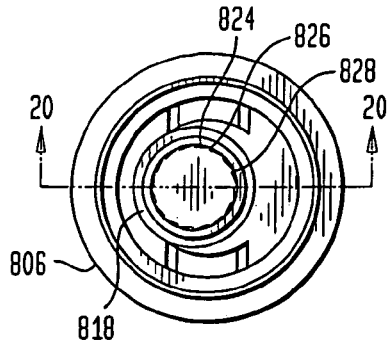
FIG. 21 is a top plan view of the base.
Figure 20:
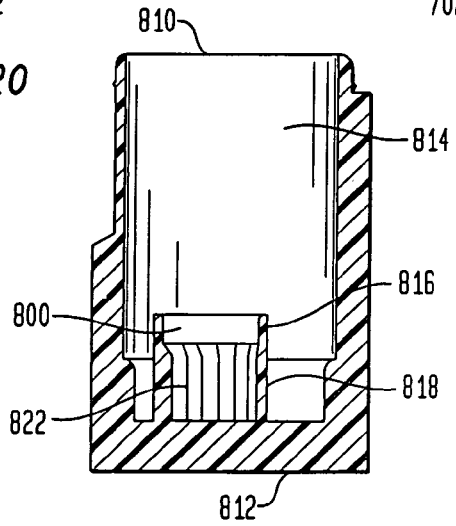
FIG. 20 is a cross-sectional view of the base.

As shown in FIG. 20, the top 810 of the base 20 is open while the bottom 812 is closed to form a cavity 814. Located within the cavity 814 at the bottom 812 is a ratchet mechanism 816. The ratchet mechanism 816 includes a cylindrical member 818 that extends from the bottom 812 of the base into the cavity 814. As shown in FIG. 21, the cylindrical member 818 is offset toward the front 806 of the base 20. The offset serves to align the ratchet mechanism 816 with the extension member 416 of the piston 12.

The cylindrical member 818 has an upper portion 820 which is smooth. The lower portion 822 of the cylindrical member 818 is ribbed with a series of triangular ramp members 824 extending from their leading edge 826, having the same diameter as the interior portion of the lower section 822, to a ramped edge 828 having an interior diameter less than that of the lower section 822, such that a ramp is formed.

When the applicator 4 is assembled, it will be appreciated that the base 608 of the screw 16 will be received in the smooth upper portion 820 of the ratchet mechanism 816. On the other hand, the winged portion 602 of the screw 16 will be received in the ramped lower section 822 of the ratchet mechanism 816. Because of the influence of the triangular ramp members 824 upon the points 614 of the L-vanes 612 of the screw 16, the geared roller 604 is only permitted to rotate in a single direction, that direction being designed in conjunction with the threaded screw to extend the piston 12 into the housing 10, forcing material therefrom.

Figure 22:
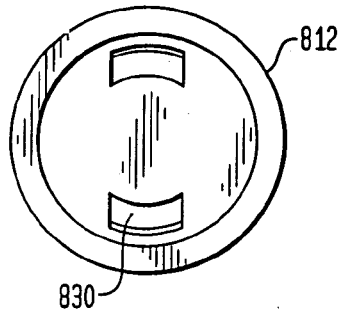
FIG. 22 is a bottom plan view of the base.

As shown in FIG. 22, the bottom 812 of the base 20 includes a plurality of snap-in holes 830. The snap-in holes 830 are sized to accommodate the distal end 214 of the tabs 206 of the cartridge housing 10 upon assembly of the applicator 4. Once so assembled, the locking portion 210, and particularly the ridge 216 of the cartridge housing 10, will bias against the snap-in holes 830 to prevent the housing 10 from being removed from the base 20.

Referring again to FIG. 3, several aspects of the dispenser 2 for fluid material will now be discussed in greater detail. For example, the cover 6 is designed to hermetically seal the fluid material within the compartment 204 of the cartridge housing 10, as well as the apertures 300 of the pad 8. This feature is enabled by the interaction of the inner ring 108 of the cover 6 with the pad 8. When the cover 6 is placed over the applicator 4, the inner ring 108 presses against the pad 8 to compress the pad. This hermetically seals the typically volatile fluid material. To ensure that the cover 6 remains on the applicator 4 with sufficient force to retain the hermetic seal, the cover is provided with nibs 106 extending into the compartment 104 of the cover. The nibs 106 fit over the flange 801 of the base 20 to snap the cover 6 in place and hold the cover tight. Meanwhile, the outer ring 110 of the cover 6 extends to fit over the top 202 of the cartridge housing 10. This pressure fit helps to align the cover 6 over the housing 10, as well as assisting to hold the cover in place to hermetically seal the dispenser 2.

As discussed, the ratcheting action of the screw 16 relative to the base 20 only permits displacement of the piston 12 in a single direction, i.e., to push the fluid material from within the cartridge housing 10. This limited movement also assists to preserve the fluid material and reduce contamination as none of the material which has been exposed to the atmosphere will be permitted to be drawn back into the cartridge housing 10.

Once the applicator 4 is assembled, it will be appreciated that it may not be disassembled readily. In that regard, the tabs 206 of the cartridge housing 10 lock into the snap-in holes 830 of the base 20 to lock each of the components in place. The tabs 206 may be bent such that the ridges 216 clear the snap-in holes 830, but it is not intended that this be done. In fact, the dispenser 2 produced in accordance with this invention may have a sticker (not shown), such as a product identification sticker, attached to the bottom 812 of the base 20 to prevent disassembly. A frangible sticker may be utilized in this regard to evidence tampering with the fluid material.

As an exemplary use of the dispenser for fluid materials, the dispenser 2 may be utilized to store and apply semi-solid lipstick material. In this example, the semi-solid lipstick material is stored within the compartment 204 of the housing 10 between the pad 8 and the piston 12. Typically, the dispenser 2 will be sold to consumers in this filled condition. To use the dispenser 2, the consumer would first remove the cover 6, and of course any protective packaging or labeling also provided. The consumer would then grasp the applicator 4 in one hand, for example, using the last three digits of right hand to secure the lower section 802 of the base 20. The consumer may then advance the lipstick material from within the housing 10 by rotating the sleeve 18, for example in a clockwise direction, with ones thumb and forefinger in a one-handed operation. Such rotation will cause the carrier 14 to progressively unthread from the screw 16, advancing the piston 12 toward the pad 8 and forcing the lipstick material out of the housing. It will be appreciated that the inside diameter of the sleeve 18, as well as the diameter of the geared roller 604 and the thread pitch of the threaded portion 600 of the screw 16, will all contribute to determine the number of revolutions required to dispense a given volume of material. Typically, the number of rotations will be calculated to be sufficient to accurately meter the material discharged, without requiring an excessive number of revolutions.

As discussed, the ratchet mechanism of the base 20 and the extension member 416 of the piston 12 are offset from the centerline of the applicator 4. Their respective offsets match, such that the screw 16 and carrier 14 will also be offset. The offset permits the geared roller 604 to remain in contact with the internal threaded portion of the sleeve 18 during operation of the applicator 4.

Once the lipstick material is ejected from the cartridge housing 10, it will be temporarily stored in the apertures 300 of the pad 8. Of course, the apertures 300 may be provided in any number of sizes and patterns, arranged to communicate preferably with a similar number of apertures 230 of the housing 10. The apertures may also be provided in the shape of a corporate logo, or other distinguishing mark indicative of the source of the product.

The stored lipstick material may then be applied to the lips of the consumer by pressing the pad 8 against the lip surface. Because of the resiliency and compressibility of the pad 8, the volume of lipstick material applied to the lips is directly proportional to the pressure applied to the pad. More specifically, pressure applied to the pad 8 will cause it to deform by compression. Such deformation reduces the effective volume of the apertures 300, squeezing material out from therein. Thus, the more pressure applied to the pad 8, the greater the reduction of volume and potential discharge of material for application. Because of this feature, the user may advance the lipstick material as described, and then apply it once rotation has ceased, so as to ensure a neat and accurate process. It will be noted, however, that the pads resiliency will preferably be great enough so the user may accurately gauge the pressure applied thereto, but not so great as to prevent deformation.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. The combination of a cosmetics dispenser and a cosmetic material contained therein, comprising:

a housing having a hollow interior, said housing having a non-concave first end with at least one first unobstructed aperture therethrough, the first end of said housing being arranged non-perpendicularly to a longitudinal axis of said housing;

a compliant pad overlying the first end of said housing and having at least one second aperture in registration with the at least one first aperture of said housing;

a semi-solid, cosmetic material contained within said housing, the cosmetic material being selected from the group consisting of lip products, mascaras, and eye shadow;

a piston moveable within said housing towards the first end of said housing, said piston adapted for forcing the cosmetic material through the at least one first aperture and the at least one second aperture, and a screw adapted for rotation operatively coupled to said piston, whereby rotation of said screw advances said piston within said housing, wherein said housing further includes an opening and said screw further includes a geared roller attached thereto, a portion of said geared roller extending through the opening, whereby rotation of said geared roller advances said piston towards the first end of said housing, and wherein said screw is coupled to said piston by a carrier having an internal threaded portion engaged by said screw.

2. The combination of a cosmetics dispenser and a cosmetic material contained therein, comprising:

a housing having a hollow interior, said housing having a non-concave first end with at least one first unobstructed aperture therethrough, the first end of said housing being arranged non-perpendicularly to a longitudinal axis of said housing;

a compliant pad overlying the first end of said housing and having at least one second aperture in registration with the at least one first aperture of said housing;

a semi-solid, cosmetic material contained within said housing, the cosmetic material being selected from the group consisting of lip products, mascaras, and eye shadow;

a piston moveable within said housing towards the first end of said housing, said piston adapted for forcing the cosmetic material through the at least one first aperture and the at least one second aperture, a screw adapted for rotation operatively coupled to said piston, whereby rotation of said screw advances said piston within said housing, wherein said housing further includes an opening and said screw further includes a geared roller attached thereto, a portion of said geared roller extending through the opening, whereby rotation of said geared roller advances said piston towards the first end of said housing; and a sleeve surrounding a portion of said housing, said sleeve having an internal threaded portion engaging a portion of said geared roller extending from the opening, whereby rotation of said sleeve rotates said geared roller, and a ratchet mechanism operatively coupled to said screw, whereby said screw is rotatable in only a single direction, wherein said ratchet mechanism is offset from a longitudinal axis of said housing.

3. The combination of a cosmetics dispenser and a cosmetic material contained therein, comprising:

a housing having an opening, said housing having a first end supporting a compliant pad, the first end and said pad each having at least one unobstructed aperture therethrough;

a semi-solid, cosmetic material contained within an upper portion of the housing, the cosmetic material being selected from the group consisting of lip products, mascaras, and eye shadow;

a piston moveable within the upper portion of said housing;

a carrier having an upper end coupled to said piston and an internal threaded lower end;

a screw having a threaded portion received within a lower portion of said housing, said screw engaging the internal threaded lower end of said carrier, whereby rotation of said screw advances said piston towards the first end of said housing, thereby forcing the cosmetic material out of said housing through the aperture in each of the first end of said housing and said pad, said screw further including a geared roller extending from within said housing through the opening;

a rotatable sleeve surrounding a portion of said housing, said sleeve having an internal threaded lower end engaging said geared roller; and a base coupled to the lower portion of said housing, wherein said pad has a hardness in the range of 15-75 durometer, on the Shore 00 scale.

4. The cosmetics dispenser and cosmetic material combination of claim 3, wherein rotation of said sleeve causes rotation of said geared roller and advancement of said carrier for advancing said piston within said housing towards the first end.

5. The cosmetics dispenser and cosmetic material combination of claim 3, wherein said housing further includes a spine extending along its length, wherein said piston further includes a flat wall arranged adjacent to the spine to prevent rotation of said piston relative to said housing.

6. The cosmetics dispenser and cosmetic material combination of claim 3, wherein said screw further includes at least one vane and said base further includes a series of ramped members, whereby the at least one vane permits rotation of said screw in a single direction.

7. The cosmetics dispenser and cosmetic material combination of claim 3, wherein the cosmetic material is lipstick material.

8. The cosmetics dispenser and cosmetic material combination of claim 3, wherein said pad has a hardness in the range of 30-50 durometer, on the Shore 00 scale.

9. The cosmetics dispenser and cosmetic material combination of claim 3, wherein said compliant pad is overmolded with said housing, such that there is a seamless connection between said compliant pad and said housing.

10. The cosmetics dispenser and cosmetic material combination of claim 3, further comprising a cover adapted to fit over said housing.

11. The cosmetics dispenser and cosmetic material combination of claim 10, wherein the cover has an outer wall, an interior cavity, and an inner ring disposed in the interior cavity and carried by said cover, and the inner ring abuts said compliant pad when said cover is installed on said housing, so as to hermetically seal the cosmetic material in the dispenser.

12. The cosmetics dispenser and cosmetic material combination of claim 11, wherein said cover further comprises an outer ring between the inner ring and the outer wall of said cover, the outer ring being adapted to center said cover on said housing.

13. The cosmetics dispenser and cosmetic material combination of claim 12, wherein the inner and outer rings are eccentrically arranged within the interior cavity of said cover.

14. The combination of a cosmetics dispenser and a cosmetic material contained therein, comprising:

a housing having a non-concave first end supporting a compliant pad and having at least one unobstructed aperture for the discharge of cosmetic material therethrough, the first end of said housing being arranged at an angle to a longitudinal axis of said housing;

a semi-solid, cosmetic material contained within said housing, the cosmetic material being selected from the group consisting of lip products, mascaras, and eye shadow; and a cover adapted to fit over said housing, said cover having an outer wall, an interior cavity, and an inner ring disposed in the interior cavity and carried by said cover, the inner ring abutting said compliant pad when said cover is installed on said housing, so as to hermetically seal the cosmetic material in the dispenser, wherein said pad has a hardness in the range of 15-75 durometer, on the Shore 00 scale, and wherein said cover further comprises an outer ring between the inner ring and the outer wall of said cover, the outer ring being adapted to center said cover on said housing.

15. The cosmetics dispenser and cosmetic material combination of claim 14, wherein the inner and outer rings are eccentrically arranged within the interior cavity of said cover.

16. The combination of a cosmetics dispenser and a cosmetic matenal contained therein, comprising:

a housing having a hollow interior, said housing having a non-concave first end with at least one first unobstructed aperture therethrough, the first end of said housing being arranged non-perpendicularly to a longitudinal axis of said housing;

a compliant pad overlying the first end of said housing and having at least one second aperture in registration with the at least one first aperture of said housing;

a semi-solid, cosmetic material contained within said housing, the cosmetic material being selected from the group consisting of lip products, mascaras, and eye shadow;

a piston moveable within said housing towards the first end of said housing, said piston adapted for forcing the cosmetic material through the at least one first aperture and the at least one second aperture, and a cover adapted to fit over said housing, wherein the cover has an outer wall, an interior cavity, and an inner ring disposed in the interior cavity and carried by said cover, and the inner ring abuts said compliant pad when said cover is installed on said housing, so as to hermetically seal the cosmetic material in the dispenser.

17. The cosmetics dispenser and cosmetic material combination of claim 16, wherein said cover further comprises an outer ring between the inner ring and the outer wall of said cover, the outer ring being adapted to center said cover on said housing.

18. The cosmetics dispenser and cosmetic material combination of claim 17, wherein the inner and outer rings are eccentrically arranged within the interior cavity of said cover.

19. The combination of a cosmetics dispenser and a cosmetic material contained therein, comprising:

a housing having a non-concave first end supporting a compliant pad and having at least one unobstructed aperture for the discharge of cosmetic material therethrough, wherein said pad has a hardness in the range of 15-75 durometer, on the Shore 00 scale, and the first end of said housing is arranged at an angle to a longitudinal axis of said housing;

a semi-solid, cosmetic material contained within said housing, the cosmetic material being selected from the group consisting of lip products, mascaras, and eye shadow; and a cover adapted to fit over said housing, wherein said cover further comprises an outer ring between the inner ring and the outer wall of said cover, the outer ring being adapted to center said cover on said housing.

20. The cosmetics dispenser and cosmetic material combination of claim 19, wherein the inner and outer rings are eccentrically arranged within the interior cavity of said cover.

* * * * *

UNITED STATES PATENT AND TRADEMARK OFFICE

CERTIFICATE OF CORRECTION

PATENT NO. : 7,309,184 B2
APPLICATION NO. : 10/641651
DATED : December 18, 2007
INVENTOR(S) : John D. Butcher et al.

It is certified that error appears in the above-identified patent and that said Letters Patent is hereby corrected as shown below:

COLUMN 5:

Line 63, "8," should read --FIG. 8,--.

COLUMN 6:

Line 54, "functions" should read --function--; and
Line 55, "match" should read --matches--.

Signed and Sealed this

Seventeenth Day of June, 2008

JON W. DUDAS
*Director of the United States Patent and Trademark Office*